US008555445B2

(12) United States Patent
Fu et al.

(10) Patent No.: US 8,555,445 B2
(45) Date of Patent: Oct. 15, 2013

(54) HYDRAULIC DRIVEN JAW-TYPE CLUTCH IMPELLER COMBINATION AND SWIMMING POOL BOTTOM HYDRAULIC PUSHED AUTOMATIC CLEANER COMPRISING SAME

(76) Inventors: Guilan Fu, Tianjin (CN); Qian Yu, Tianjin (CN); Changsheng Zou, Tianjin (CN); Zhi Yi Zou, legal representative, Tianjin (CN); Jian Liu, Tianjin (CN); Bichang Wang, Tianjin (CN); Xinru Gong, Tianjin (CN); Xianozhou Lv, Tianjin (CN)

( * ) Notice: Subject to any disclaimer, the term of this patent is extended or adjusted under 35 U.S.C. 154(b) by 0 days.

(21) Appl. No.: 13/499,551

(22) PCT Filed: Jun. 29, 2010

(86) PCT No.: PCT/CN2010/074662

§ 371 (c)(1),
(2), (4) Date: Jul. 16, 2012

(87) PCT Pub. No.: WO2011/038602

PCT Pub. Date: Apr. 7, 2011

(65) Prior Publication Data

US 2012/0279001 A1 Nov. 8, 2012

(30) Foreign Application Priority Data

Sep. 30, 2009 (CN) ..... 2009 1 0177497
Sep. 30, 2009 (CN) ..... 2009 2 0217844

(51) Int. Cl.
*E04H 4/16* (2006.01)

(52) U.S. Cl.
USPC ..... 15/1.7

(58) Field of Classification Search
USPC ..... 15/1.7; 416/147
See application file for complete search history.

(56) References Cited

U.S. PATENT DOCUMENTS 5,706,539 A * 1/1998 Fukuda ..... 15/1.7
7,118,632 B2 * 10/2006 Sumonthee ..... 134/6

FOREIGN PATENT DOCUMENTS

CN 101101005 A 1/2008
CN 101666168 A 3/2010
JP 05-028921 A 11/1993

* cited by examiner

*Primary Examiner* — Randall Chin
(74) *Attorney, Agent, or Firm* — Maschoff Brennan

(57) ABSTRACT

A swimming pool bottom hydraulic pushed automatic cleaner includes an underwater cleaner and a control power supply connected by a buoyancy cable. The underwater cleaner includes a housing cover, housing body, filter, double extension shaft motor assembly, hydraulic driven jaw-type clutch impeller combination, water inlet/outlet flow passage, wheel and bracket, an isolated hood and a cable with floaters. Along with the changing of the rotating direction of the motor, the impeller combination is engaged and disengaged under the action of hydraulic power to change the working state of the impeller, thereby changing water outlet of injection water flow and further changing the travel direction of the cleaner. The housing touches a wall to cause the cleaner to adjust the direction after touching the wall. Furthermore, two or more axial-flow pumps are arranged horizontally and parallelly, so that the cleaner has turning function and orderly complete coverage cleaning is realized.

19 Claims, 9 Drawing Sheets

HYDRAULIC DRIVEN JAW-TYPE CLUTCH IMPELLER COMBINATION AND SWIMMING POOL BOTTOM HYDRAULIC PUSHED AUTOMATIC CLEANER COMPRISING SAME

TECHNICAL FIELD OF THE INVENTION

The present invention relates to a swimming pool cleaning equipment part and swimming pool cleaning equipment comprising the part, and in particular relates to an automatic cleaner for cleaning a bottom of a swimming pool.

BACKGROUND OF THE INVENTION

Keep the swimming pool clean is very important, it is crucial to the swimmer's health. Therefore, the swimming pool has to be cleaned regularly to remove sewage deposited at the bottom of the swimming pool, to prevent bacteria and algae from breeding and ensure that water in the swimming pool is clean and the swimming pool is sanitary.

Usually, a method for removing sewage deposited at the bottom of the swimming pool is to suck the sewage deposited at the bottom of the swimming pool by using a sucker type device. In the prior art, an advanced method is to clean the bottom of the swimming pool by using a cleaner which is automatically moveable at the bottom of the swimming pool. The cleaner is provided with a pump in the shell thereof. The water containing sewage at the bottom of the swimming pool is sucked into the shell using the one-way valve at the bottom of the shell by filter, then the filtered clean water is discharged out of the shell, and the cleaner can move driven by pressure of discharge water. In such a way, where the cleaner passes, the sewage deposited at the bottom of the swimming pool is sucked into the cleaner and trapped in the filter, clean water is discharged into the swimming pool, which realizes the cleaning of the bottom of the swimming pool, and at the same time avoids pollution to the pool water.

In the prior art, there are many ways to realize the automatic movement of the cleaner at the bottom of the swimming pool, such as in a motor-driven way, in a way of pump discharged water pressure-driven, in a way of changing the travel direction of the cleaner by changing the rotating direction of the motor, and in a way of changing the travel direction by changing pump drainage flow direction through valve. These cleaners are complex in structure, and performance features of main parts of these cleaners have not been fully used. The zigzag movement is the existing basic way in which the cleaner moves, so it is difficult to ensure that the travel route of the cleaner covers the whole bottom of the swimming pool. The existing pool bottom cleaner basically has no turning function and has bad maneuvering performance. If complete coverage cleaning is effectively performed to the bottom of the swimming pool, it is necessary to make the cleaner have the functions of turning and maneuvering, in such a way, the cleaner travels according to the designed cleaning route to realize complete coverage cleaning.

SUMMARY OF THE INVENTION

The goal of the present invention is to design a swimming pool bottom hydraulic pushed automatic cleaner with simple structure. An impeller hydraulic driven clutch is used for making the impellers on the two ends of double extension shaft of single motor change the direction to drive the cleaner to travel. The leading and trailing edges of the cleaner shell and the longitudinal shaft of the cleaner form different included angles. The leading edge or trailing edge of the housing is a part touching pool wall, after the cleaner automatically adjusts the direction when the leading edge touches the wall or the trailing edge touches the wall, it has different travel directions when traveling in an opposite direction, the route along which the cleaner travels reversely after touching the wall for a long period of time is one-way jagged. Therefore, the cleaner can automatically clean the bottom of the swimming pool regularly. The cleaner is provided with a group of suction pipes, which rapidly suck the pool water under the leading edge of the advancing edge of the underwater cleaner to prevent the underwater cleaner from disturbing and diffusing the sewage deposited at the bottom of the pool during traveling. Furthermore, the present invention provides a swimming pool bottom hydraulic pushed automatic cleaner with turning function.

In order to achieve the goal, the present invention adopts the technical scheme as follows:

A hydraulic driven jaw-type clutch impeller combination comprises an impeller with sharp teeth on an end surface of a hub and a shaft sleeve with sharp teeth on an end surface, the two end surfaces with sharp teeth being a pair of meshing surfaces, wherein the shaft sleeve is fixed in the root of an outrigger shaft of a double extension shaft motor assembly; the impeller is sleeved on the end portion of the outrigger shaft; the impeller is axially slidable and rotatable; the impeller and the shaft sleeve constitute a pair of jaw-type clutches; along with the changing of the rotating direction of a motor, the impeller and the shaft sleeve are reliably engaged and disengaged under the action of hydraulic power to change the working state of the impeller.

A swimming pool bottom hydraulic pushed automatic cleaner comprises an underwater cleaner and a control power supply, which are connected together by a cable, wherein the underwater cleaner comprises a housing cover part, a housing body part, a filter, a double extension shaft motor assembly, a hydraulic driven jaw-type clutch impeller combination, a water inlet/outlet flow passage, a wheel and bracket, an isolated hood and a cable; the housing cover part, the housing body part, the double extension shaft motor assembly, the hydraulic driven jaw-type clutch impeller combination, the water inlet/outlet flow passage and the cable constitute an axial-flow pump with double water injection nozzle; both ends of the motor of the double extension shaft motor assembly are provided with outrigger shafts; the motor is watertight; the hydraulic driven jaw-type clutch impeller combination is installed on the outrigger shaft of the double extension shaft motor assembly; the water inlet/outlet flow passage comprises a flow passage, a flow guide cover and a swinging cap; the water inlet/outlet flow passage is a water inlet/outlet channel, with a water inlet in the front end and a water outlet in the tail end; the housing cover part comprises a housing cover and a lock catch; the housing body part comprises a housing body, a one-way water inlet valve, a suction pipe, a one-way drain valve and a deflection member; the housing cover and the housing body are hermetically connected with each other through the lock catch; the one-way water inlet valve is arranged at the bottom of the housing body; the suction pipe is extracted from the front and rear ends at the bottom of the housing body, and extended under the leading and trailing edges of the underwater cleaner; the deflection member is an adjustment feeler lever arranged in the leading edge of the housing cover; the filter comprises a filter bracket and a filter bag; the filter is installed at the bottom of the housing body; the one-way water inlet valve and the upper end of the suction pipe are arranged within the filter; the wheel and the bracket is fixedly installed on the side of the housing body; the isolated hood is placed between the filter and the double extension shaft motor assembly and installed on the housing cover; the control power supply comprises a power supply, a control circuit and a chassis.

Further, the number of the double extension shaft motor assembly is two, the two assemblies are arranged parallelly, and provided with four water outlet injection nozzles in total; the automatic cleaner also comprises a remote controller, which performs wireless remote control on the cleaner and comprises a communication circuit, a battery and a housing.

The power supply is a 12V AC power supply; the control circuit is used for controlling the ON/OFF and turning direction of the motor, as well as the working procedure of the motor; the time for reward and forward movement is set according to the size of the swimming pool to realize the reserve movement after pool wall touching.

A motor shell is made of metal material.

The cable is a buoyancy cable, which comprises a cable and floaters.

The suction pipe is arranged in the front end and the rear end at the bottom of the underwater cleaner; the ends of the suction pipe are under the leading and trailing edges of the housing; the orifice of the suction pipe is funnel-shaped.

The one-way drain valve is arranged on the lower portion of the housing body side, and the cover plate of the valve is an elastic silica gel plate.

Based on the technical scheme of the present invention, by further adopting double axial-flow pumps or multiple axial-flow pumps, it is possible to realize the bottom underwater cleaner with turning and maneuvering functions. By further configuring a remote controller, it is further possible to realize a remote-controlled ordered pool bottom automatic cleaner, which can effectively perform complete coverage cleaning for the bottom of the swimming pool.

A remote-controlled ordered pool bottom automatic cleaner comprises an underwater cleaner with turning function, a control power supply and a remote controller, in which the underwater cleaner with turning function is connected with the control power supply through a cable; the remote controller performs wireless remote control on the cleaner; the underwater cleaner with turning function is formed in a way that in any swimming pool bottom hydraulic pushed automatic cleaner, two double extension shaft motor assemblies are arranged parallelly and provided with four water outlet injection nozzles; the control power supply comprises a power supply, a control circuit and a communication circuit and a chassis; the remote controller comprises a communication circuit, a battery and a housing.

The present invention is superior in that:

1. In the present invention, by making full use of the features of pump impeller during working, a hydraulic driven jaw-type clutch is designed, which simply and reliably realizes that, without increasing mechanism, energy and power, the working state of the impeller is changed, the direction of the pump is changed, the water outlet injection nozzle is changed and the underwater cleaner is made to change the direction.
2. The direction of the underwater cleaner is automatically adjusted after touching the wall in a way that the leading and trailing edges of the housing touch the wall, so that the travel route after wall touching is different from that before wall touching, which provides a technological basis for orderly traveling.
3. An AC low voltage watertight motor assembly special for underwater cleaner is designed with simple structure, the metal shell is contacted with water, which is good for heat emission of the motor.
4. By adopting the technology of deflecting the water outlet flow passage orifice, the horizontal direction of injection water is adjusted to generate a deflecting torque, thereby realizing the turning function of the cleaner.
5. A suction pipe is arranged under the leading and trailing edges of the cleaner to prevent the underwater cleaner from disturbing and diffusing the sewage at the pool bottom during traveling or eliminate the disturbing and diffusing.
6. A one-way drain valve is arranged on the lower portion side of the housing, so that the underwater cleaner can rapidly discharge the water within the housing when taken out from water to reduce the weight of the cleaner when taken out from water, convenient for user to operate.
7. On the basis of the technology of hydraulic driven jaw-type clutch, it is possible to realize an automatic underwater cleaner with the functions of turning and maneuvering in a way that two or more axial-flow pumps are arranged horizontally and parallelly, thereby performing orderly complete coverage cleaning for the bottom of the swimming pool.
8. A way of opening the cover from the top is convenient for the installation and removal of the filter, for removing sewage filtered.
9. The present invention synthesizes and integrates many innovative technologies to make the pool bottom cleaner designed have simple structure, good performance and high cost performance.

Figure 1:
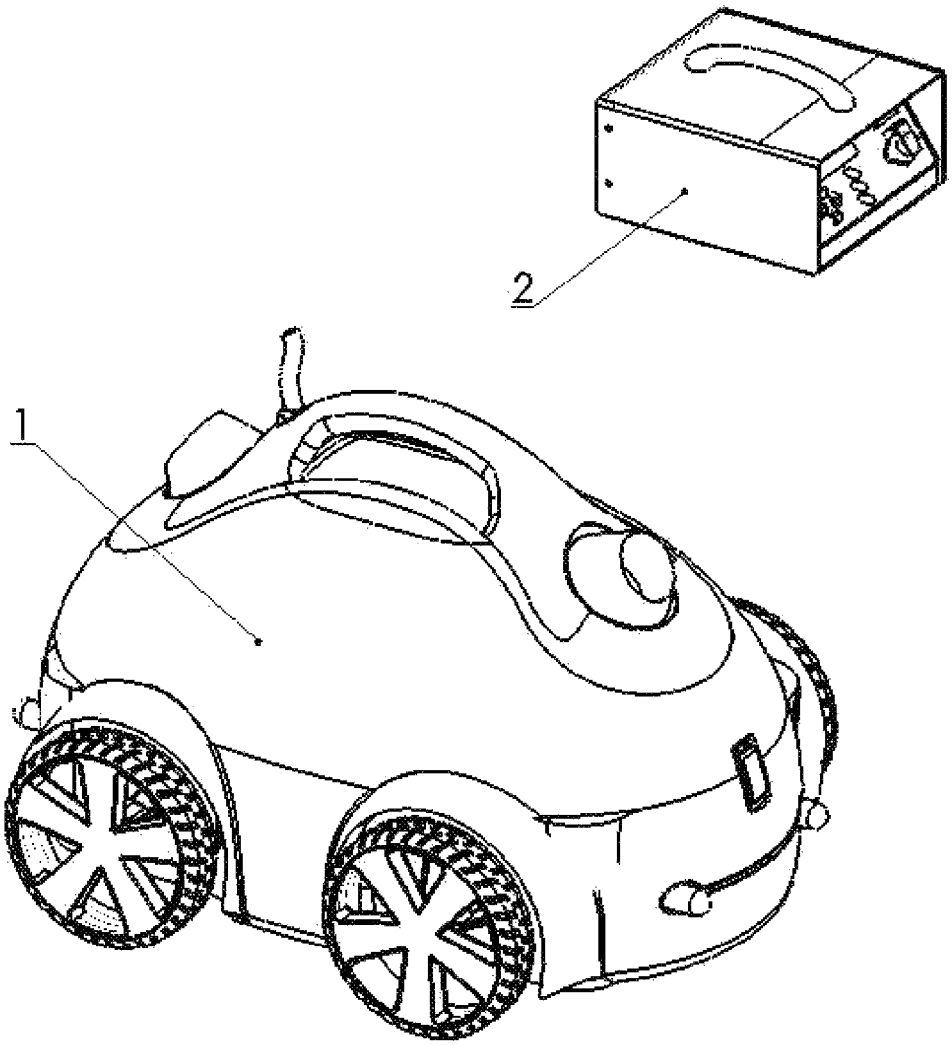
FIG. 1 is a structure diagram of a swimming pool bottom hydraulic pushed automatic cleaner.

in which:

1. underwater cleaner; 2. control power supply; 11. housing cover part;

12. housing body part; 13. filter; 14. double extension shaft motor assembly;

15. hydraulic driven jaw-type clutch impeller combination; 16. water inlet/outlet flow passage;

17. wheel and bracket; 18. isolated hood; 19. cable with floater;

111. housing cover; 112. lock catch; 121. housing body;

122. one-way water inlet valve; 123. suction pipe; 124. one-way drain valve;

125. deflection member; 131. filter bracket; 132. filter bag;

151. impeller; 152. shaft sleeve; 161. flow passage;

162. flow guide cover; 163. swinging cap; 171. wheel;

172. bracket; 191. cable; 192. floater;

21. 12V AC power supply; 22. control circuit; 23. chassis;

A. underwater cleaner with turning function; B. control power supply;

C. remote controller; A1. housing cover part; A2. housing body part;

A3. filter; A4. horizontally and parallelly arranged axial-flow pump set; A5. isolated hood;

A6. cable with floater; B1. 12V AC power supply; B2. control circuit;

B3. communication circuit; B4. chassis; C1. communication circuit;

C2. battery; C3. housing

DETAILED DESCRIPTION OF THE EMBODIMENTS

Embodiment 1

As shown in FIG. 1 to FIG. 10, the swimming pool bottom hydraulic pushed automatic cleaner comprises the underwater cleaner 1 and the control power supply 2. The underwater cleaner 1 is composed of the housing cover part 11, the housing body part 12, the filter 13, the double extension shaft motor assembly 14, the hydraulic driven jaw-type clutch impeller combination 15, the water inlet/outlet flow passage 16, the wheel and bracket 17, the isolated hood 18 and the cable with floater 19.

The housing cover part 11 comprises the housing cover 111 and the lock catch 112. The double extension shaft motor assembly 14 and the water inlet/outlet flow passage 16 are installed on the top inside the housing cover part 111, and the center line of the front and back water inlet/outlet flow passage 16 is coaxial with the double extension shaft motor assembly 14. The lock catch 112 is a connecting lock for hermetically connecting the housing cover 111 and the housing body 121 to conveniently engage and disengage the housing cover and the housing body. The housing body part 12 comprises the housing body 121, the one-way water inlet valve 122, the suction pipe 123, the one-way drain valve 124 and the deflection member 125. The housing body 121 is a lower shell of the underwater cleaner 1, the one-way water inlet valve 122 and four suction pipes 123 are arranged at the bottom, the one-way drain valve 124 is arranged on the lower portion side, and the cover plate of the valve is an elastic silica gel plate. The one-way water inlet valve 122 is a water inlet of the axial-flow pump of the underwater cleaner, when the pump works, the one-way water inlet valve 122 is sucked open, water containing sewage is sucked into the filter 13, and when the pump does not work, the one-way water inlet valve 122 is automatically shut off to prevent the sewage within the filter 13 from flowing back. The suction pipe 123, the orifice of which is funnel-shaped, is extracted from the front and rear ends at the bottom of the housing body 121, and extended under the leading and trailing edges of the underwater cleaner to prevent the underwater cleaner 1 from disturbing and diffusing the sewage at the pool bottom. The one-way drain valve 124 is used for discharging the water within the housing when the underwater cleaner 1 rises from water to reduce the weight when taken out from water. The deflection member 125 is an adjustment feeler lever arranged in the leading edge of the housing cover 111, after automatically adjusting the direction when the leading edge of the underwater cleaner 1 touches the pool wall, the longitudinal axis of the underwater cleaner 1 and the pool wall form an included angle which is not 90 degrees, and it is not separated from the pool wall vertically when traveling in an opposite direction; the trailing edge of the underwater cleaner 1 is not provided with the deflection member 125, after automatically adjusting the direction when the trailing edge touches the pool wall, it is separated from the pool wall vertically. The housing cover is an upper shell of the underwater cleaner, the double extension shaft motor assembly is fixedly installed in the top center of the housing cover, and the inlet/outlet flow passage is fixedly installed at the front and back outlet. The filter 13 comprises a filter bracket 131 and a filter bag 132; the sewage in the pool water within the housing body is trapped, the clean water flowing through the filter 13 is discharged out of the underwater cleaner 1 via the axial-flow pump, the filter is installed at the bottom of the housing body 121, and the one-way water inlet valve 122 and the suction pipe 123 are within the filter 13. The double extension shaft motor assembly 14 is a water-tight 12V AC motor with double extension shaft, the shell of which is made of metal material, which directly works in the water, with good radiating conditions.

The hydraulic driven jaw-type clutch impeller combination 15 is composed of the impeller 151 with sharp teeth on the end surface of the hub and the shaft sleeve 152 with sharp teeth on the end surface, the two end surfaces with sharp teeth where the impeller 151 is connected with the shaft sleeve 152 are a pair of meshing surfaces. The shaft sleeve 152 is fixed in the root of the outrigger shaft of the double extension shaft motor assembly 14; the impeller 151 is sleeved on the end portion of the outrigger shaft, and axially slidable and rotatable. The impeller and the shaft sleeve constitute a pair of jaw-type clutches. When the underwater cleaner 1 works, along with the changing of the rotating direction of the motor, the impeller combination 15 can be automatically engaged and disengaged under the action of hydraulic power to change the working state of the impeller. The hydraulic driven jaw-type clutch impeller combination is characterized in that along with the changing of the rotating direction of the motor, the impeller combination can be automatically engaged and disengaged under the action of hydraulic power to change the working state of the impeller, and at the same time to change the travel direction of the underwater cleaner under the action of hydraulic power. When the motor rotates in the forward direction, the impeller is in a working state. A motor shaft drives the water between the impeller hub and the shaft to rotate, under the friction force of water, the impeller is made to rotate in the same direction. At this moment, the impeller is under the action of hydraulic power on the impeller surface. The end surface with sharp teeth of the impeller slides to the sleeve and directly meshes with the end surface of the sleeve to automatically enter a working state. When the motor rotates in the reverse direction, the friction force of water between the motor shaft and the impeller hub makes the impeller rotate in the reverse direction. At this moment, the impeller is under the action of hydraulic power on the impeller surface. The end surface with sharp teeth of the impeller slides far from the sleeve until it is disengaged from the sleeve to disengage the jaw-type clutch, and the impeller automatically enters a non-working state. Identical impeller components are respectively installed on the two outrigger shafts of the double extension shaft motor. When the motor rotates, although the number of the double extension shaft is one, the rotation direction of the motor is judged with respect to the shaft end, therefore, the impeller on the outrigger shaft of the motor always keeps opposite rotation direction, that is, the impeller on one end is in the working state, while the impeller on the other end has to be in the non-working state. The underwater cleaner travels towards the other end under the action of hydraulic power of the impeller on the working end.

The water inlet/outlet flow passage 16 comprises the flow passage 161, the flow guide cover 162 and the swinging cap 163. The flow passage 161 is the water inlet/outlet flow passage of the axial-flow pump. When the flow rate increases and the pressure rises within the flow passage 161, the pressured water is ejected from the water outlet to push the underwater cleaner to travel in the reverse direction. The flow guide cover 162 is located at the water outlet of the flow passage to eliminate the rotation of water flow at the water outlet and simultaneously prevent the entry of external substances. The swinging cap 163 is a water outlet cover plate which can turn outward. When the impeller 151 is in the working state, the water flow ejected from the water outlet flow passage orifice automatically opens the swinging cap 163. When the impeller 151 is in the non-working state, no water is discharged. The swinging cap automatically covers the water outlet under the action of its own weight torque to prevent the pool water from entering the underwater cleaner 1. The wheel and bracket 17 is a traveling member of the underwater cleaner, comprising four wheels 171 and brackets 172. The brackets 172 are installed on the housing body 121. The wheels 171 are installed on stub shafts of the brackets 172 and easily rotate on the stub shafts. The isolated hood 18 is placed between the filter 13 and the double extension shaft motor assembly 14 and installed on the housing cover 111 to prevent the filter bag from being sucked into the axial-flow pump and also to prevent operators from touching the axial-flow pump by hands. The cable with floater 19 comprises the cable 191 and the floater 192, and is a connecting line of the underwater cleaning water 1 and the control power supply 2. The cable 191 inputs a 12V AC current and a control signal to the underwater cleaning water 1. The floater 192 provides buoyancy force for the cable to prevent the cable from sinking to the bottom of the pool to stop the traveling of the underwater cleaning water 1. The control power supply 2, which supplies power for and controls the underwater cleaning water 1, comprises the 12V AC power supply 21, the control circuit 22 and the chassis 23.

Figure 2:
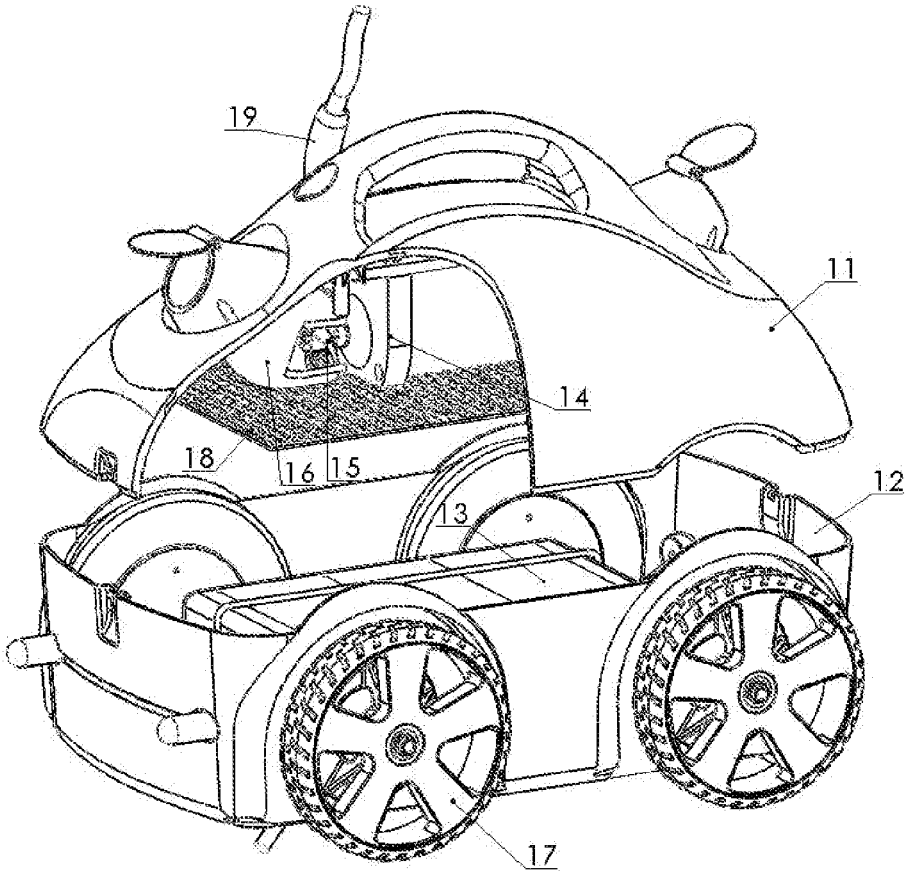
FIG. 2 is a structure diagram of an underwater cleaner.
Figure 3:
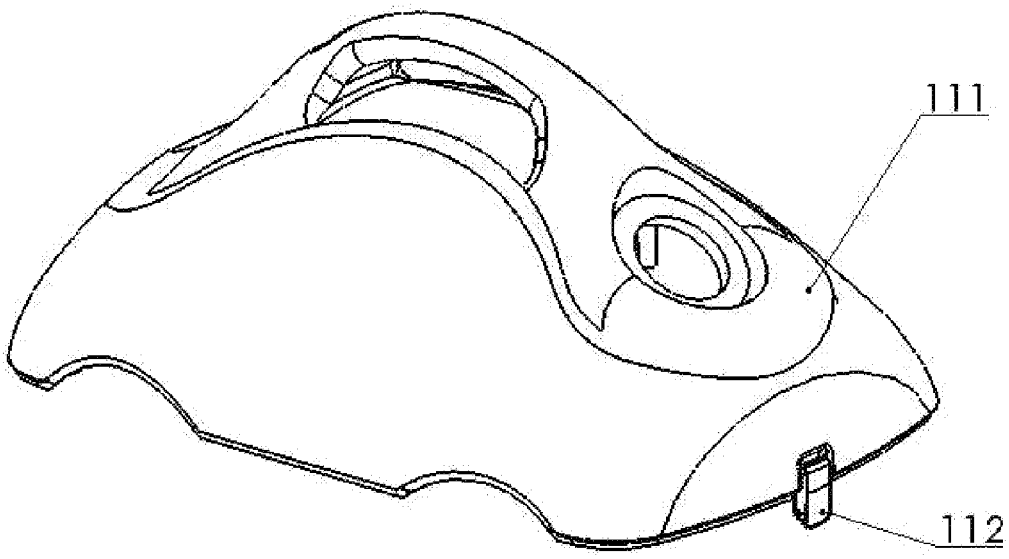
FIG. 3 is a structure diagram of a housing cover.
Figure 4:
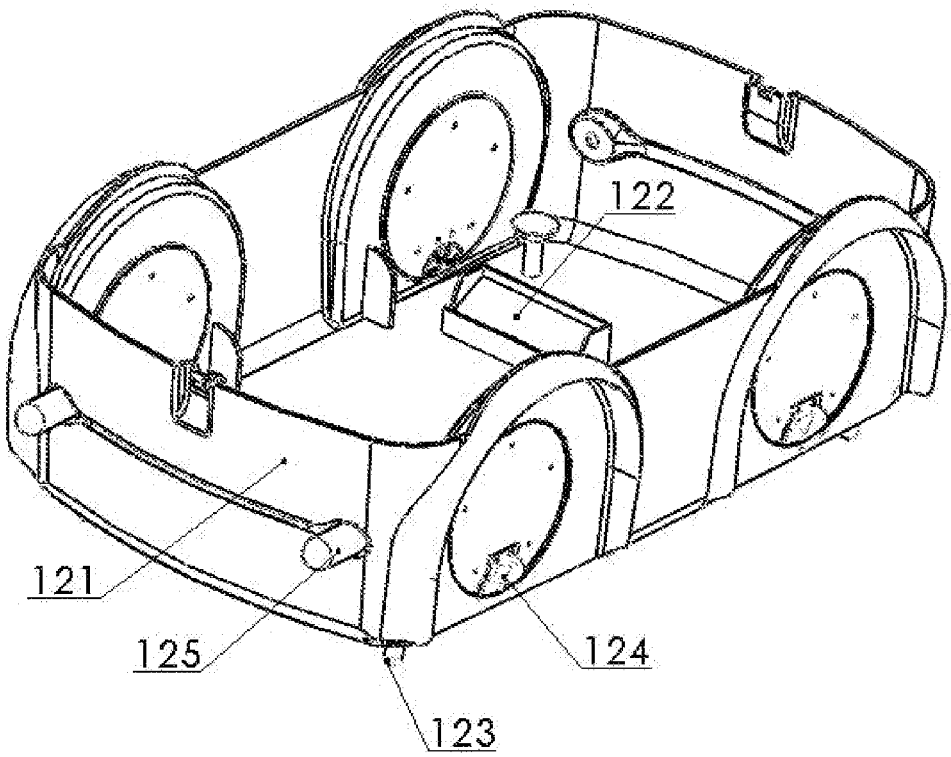
FIG. 4 is a structure diagram of a housing body.
Figure 5:
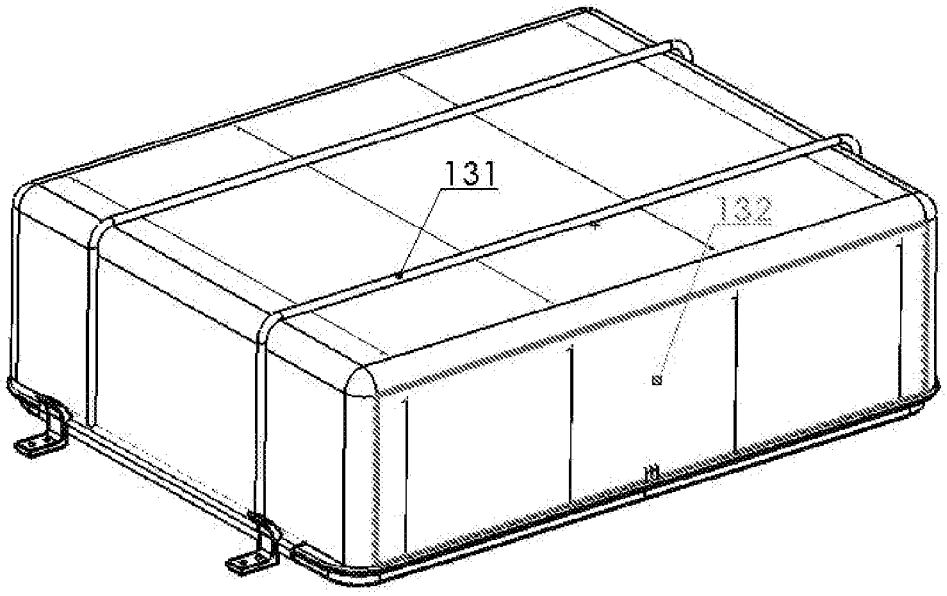
FIG. 5 is a structure diagram of a filter.
Figure 6:
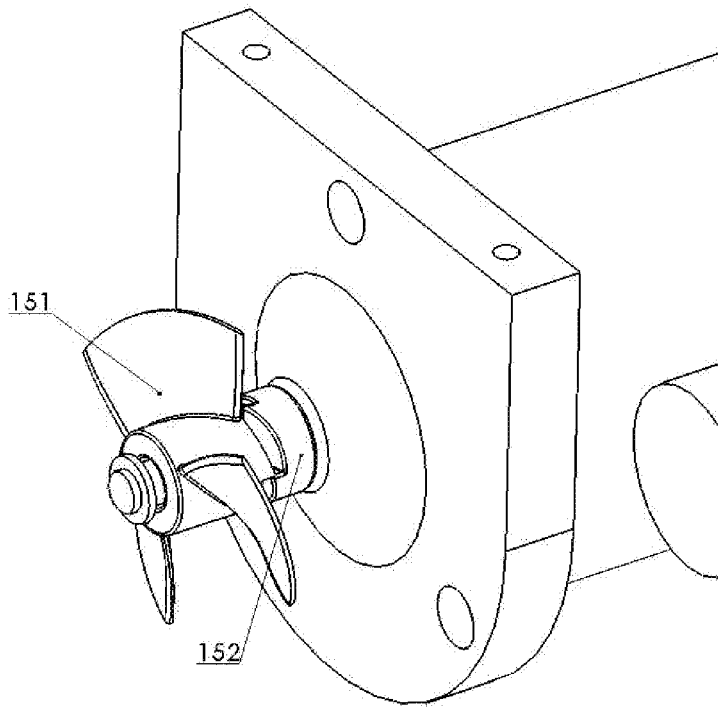
FIG. 6 is a structure diagram of a hydraulic driven jaw-type clutch impeller combination.
Figure 7:
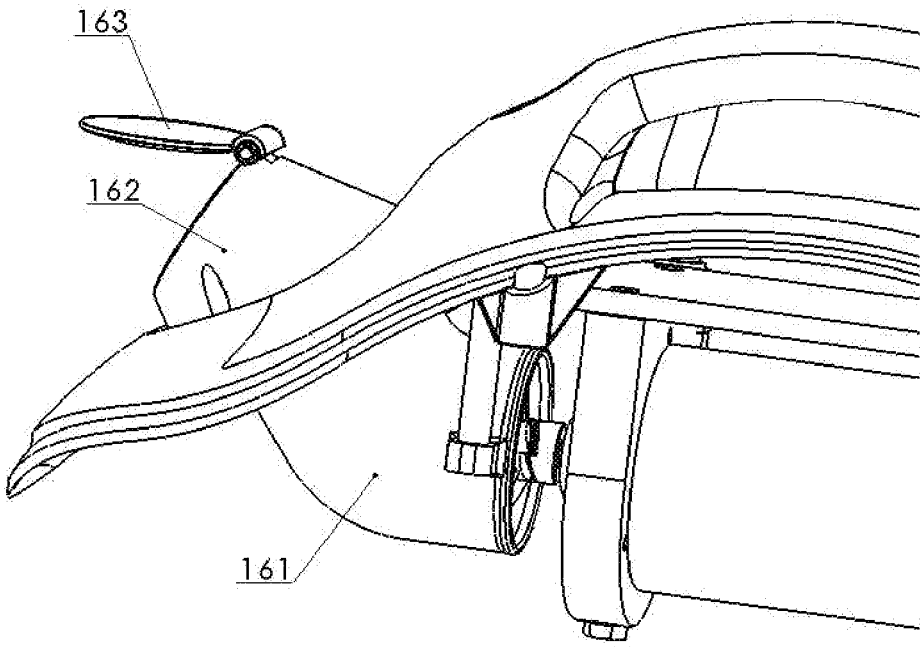
FIG. 7 is a structure diagram of a water inlet/outlet flow passage.
Figure 8:
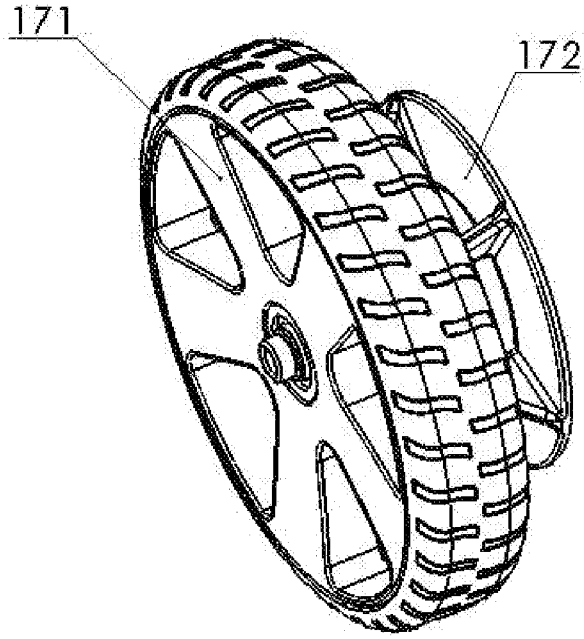
FIG. 8 is a structure diagram of a wheel and bracket.
Figure 9:
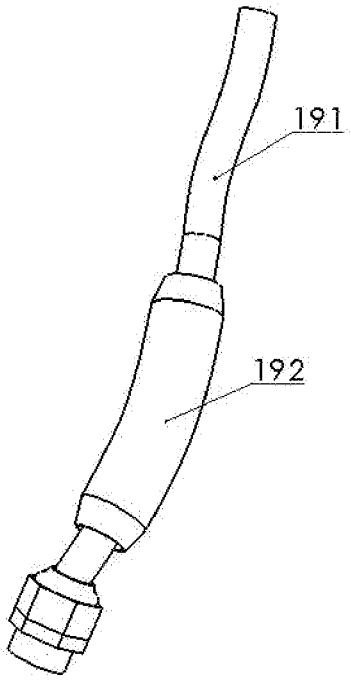
FIG. 9 is a structure diagram of a cable with floater.
Figure 10:
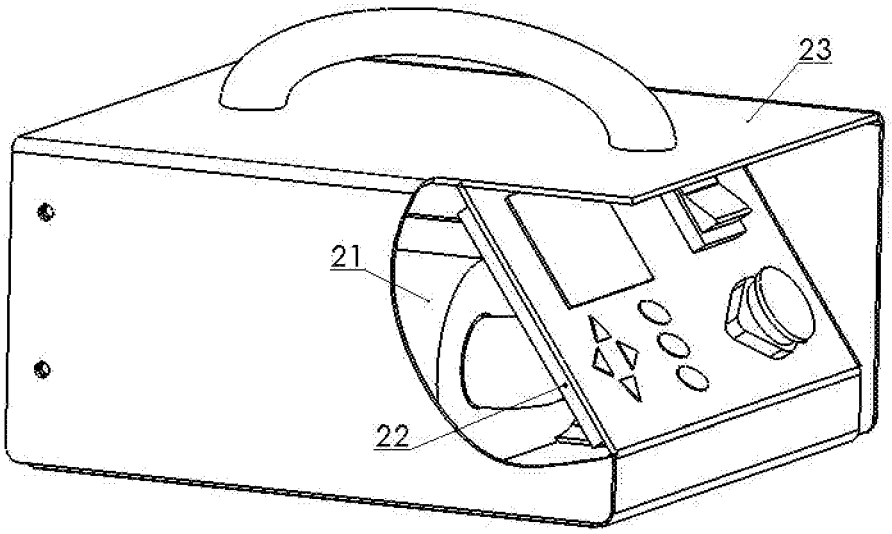
FIG. 10 is a structure diagram of a control power supply shown in FIG. 1.
Figure 11:
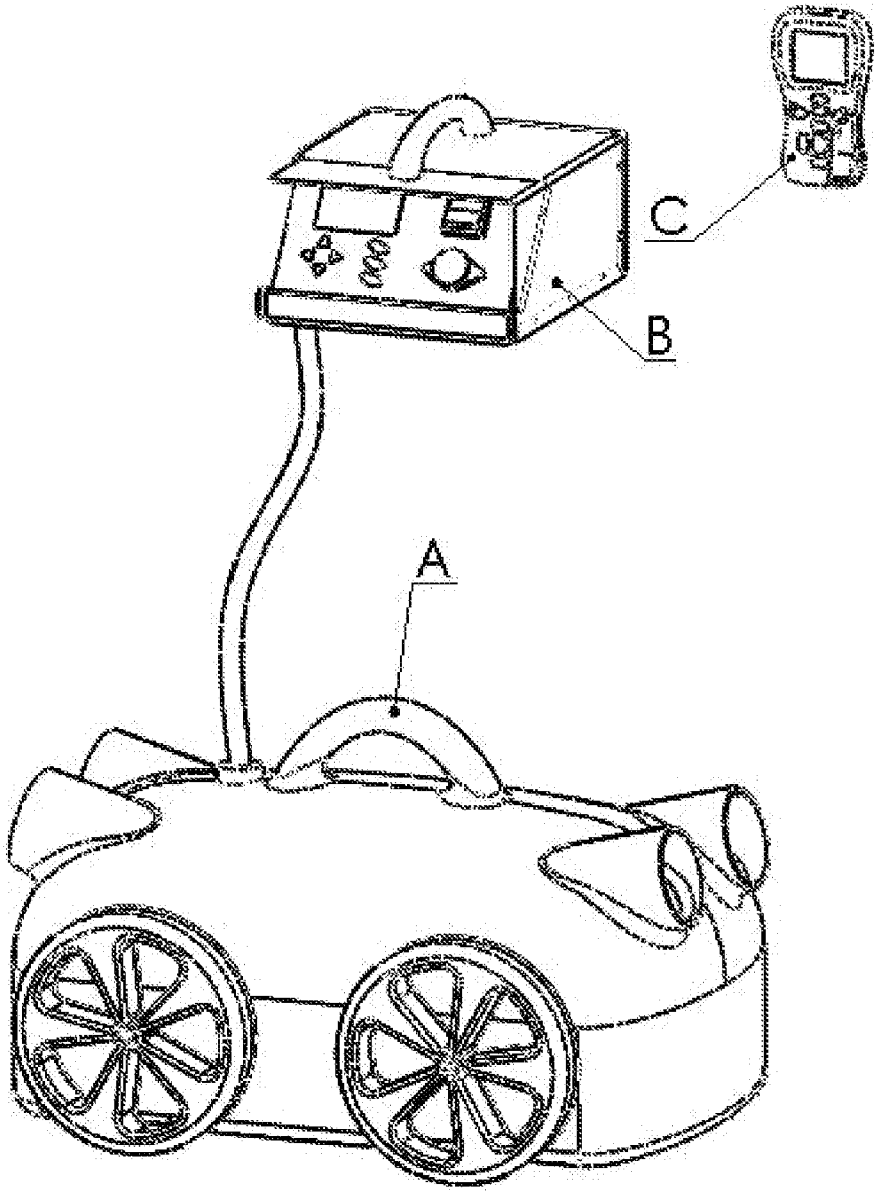
FIG. 11 is a structure diagram of a pool bottom automatic cleaner with turning function.
Figure 12:
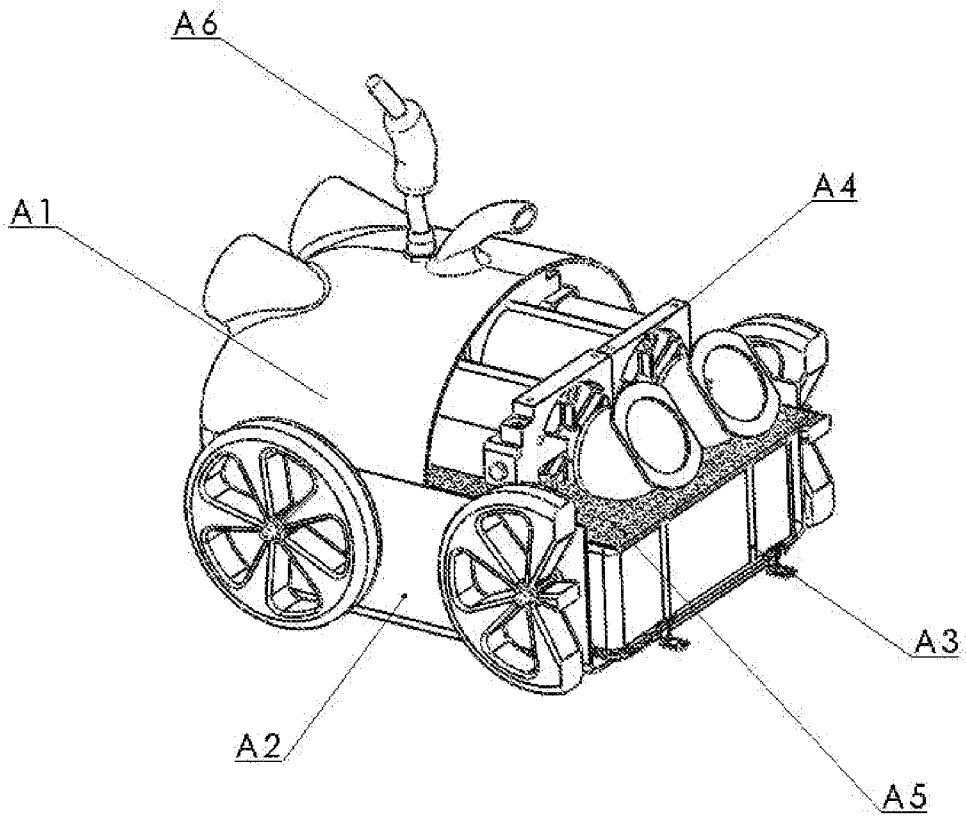
FIG. 12 is a structure diagram of an underwater cleaner with turning function.
Figure 13:
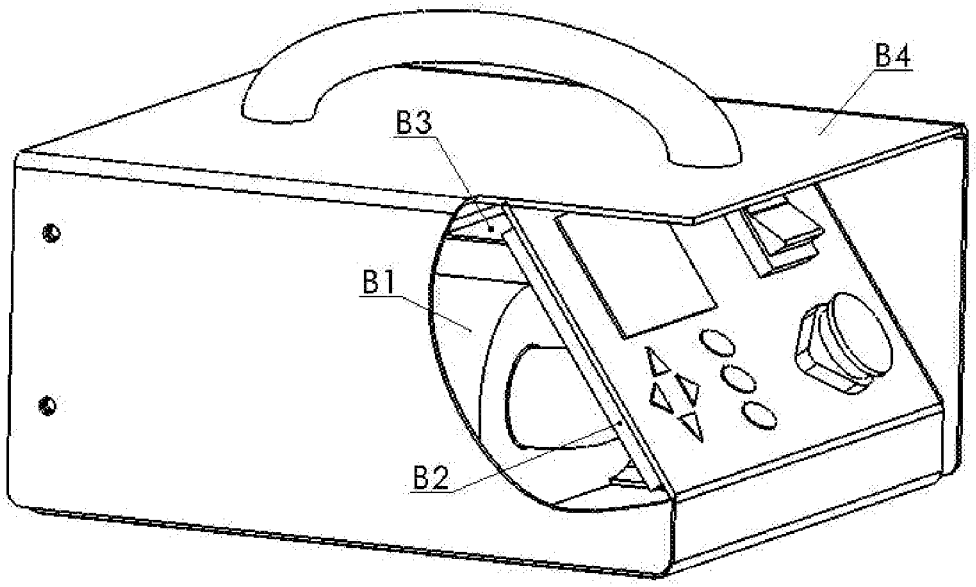
FIG. 13 is a structure diagram of a control power supply shown in FIG. 11.
Figure 14:
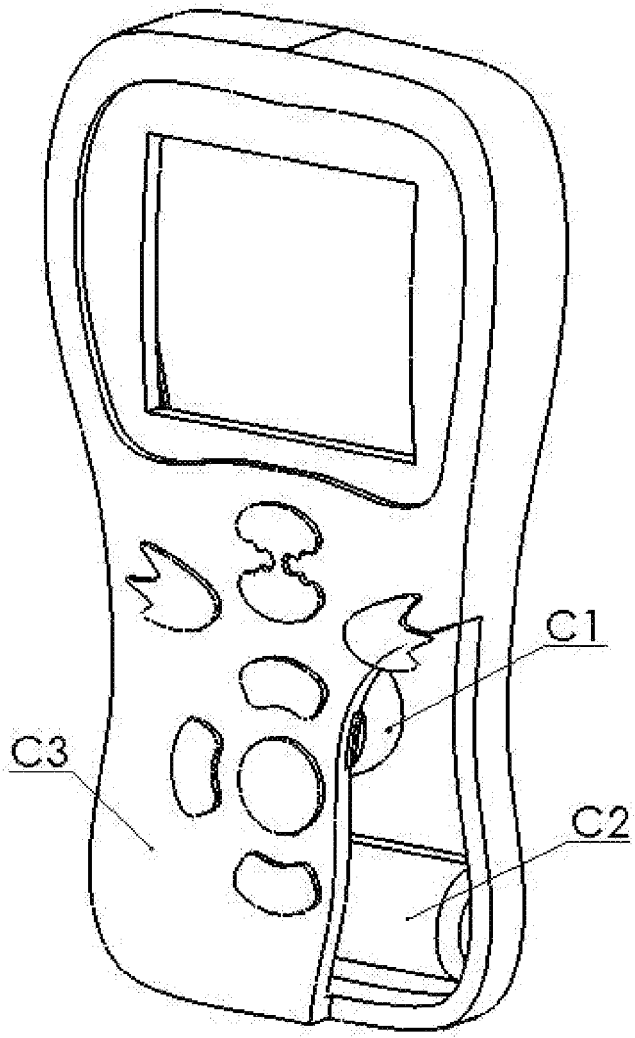
FIG. 14 is a structure diagram of a remote controller shown in FIG. 11.

As shown in FIG. 2, the housing cover part 11, the housing body part 12, the double extension shaft motor assembly 14, the hydraulic driven jaw-type clutch impeller combination 15, the water inlet/outlet flow passage 16 and the cable 19 constitute an axial-flow pump with double water injection nozzle. The housing cover part 11 and the housing body part 12 constitute an axial-flow pump shell. The one-way water inlet valve 122 at the bottom of the housing body part 12 is a water inlet of the axial-flow pump. Two water inlet/outlet flow passages 16 are installed on the housing cover 111, and the water outlet flow passage orifices of the flow passages are two water outlets of the axial-flow pump. The double extension shaft motor assembly 14 is a power part of the axial-flow pump, installed on the housing body 121. The axis of the motor is coaxial with the axis of two water inlet flow passages. Two hydraulic driven jaw-type clutch impeller combinations 15 are respectively installed on the outrigger shafts on both ends of the motor assembly 14. The shaft sleeve 152 is fixed in the root of the outrigger shaft of the motor. The impeller 151 is sleeved on the end of the outrigger shaft of the motor, and slidable on the shaft. When the outrigger shaft of the motor assembly 14 rotates, the impeller combination 15 deflects according to the motor. When the impeller combination 15 on one end is engaged, the impeller is in the working state. When the impeller combination 15 on the other end is disengaged, the impeller is in the non-working state. When the motor assembly 14 is working, the impeller on one end works. The water under the housing body 121 is sucked into the housing body 121 via the one-way water inlet valve 122 and is ejected from the water outlet of the water inlet/outlet flow passage 16 corresponding to the working impeller combination 15. When the motor changes the rotation direction, the other impeller combination 15 works. The water is ejected from the water outlet of the water inlet/outlet flow passage 16 corresponding thereto, thereby realizing the axial-flow pump with double water injection nozzle.

Embodiment 2

As shown in FIG. 11 to FIG. 14, a swimming pool bottom hydraulic pushed automatic cleaner with turning function comprises the underwater cleaner with turning function A, the control power supply B and the remote controller C. The underwater cleaner with turning function A is formed in a way that, based on the technical scheme of the underwater cleaner 1 of Embodiment 1, two or more double extension shaft motor assemblies 14 are arranged horizontally and parallelly to form two or more horizontally and parallelly arranged axial-flow pump sets A4 with corresponding water inlet/outlet flow passage 16 and the hydraulic driven jaw-type clutch impeller combination 15. When the impellers 151 on the same ends in the axial-flow pump sets A4 are working at the same time, the underwater cleaner with turning function travels along a straight line. When only one impeller 151 is working or the impellers 151 on both ends of the horizontally and parallelly arranged axial-flow pump sets A4 are working alternatively, the underwater cleaner with turning function A travels in a circling or turning manner, with turning and maneuvering functions. The bottom of the swimming pool can be subjected to orderly complete coverage cleaning according to the set cleaning route.

The control power supply B comprises the 12V AC power supply B1, the control circuit B2, the communication circuit B3 and the chassis B4. The control power supply B supplies power for and controls the procedure of the swimming pool bottom hydraulic pushed automatic cleaner with turning function.

The remote controller C, which remotely controls the cleaner, comprises the communication circuit C1, the battery C2 and the housing C3.

The underwater cleaner with turning function A can perform orderly complete coverage cleaning for the bottom of the swimming pool according to the set procedure and operation instructions from the remote controller C.

The invention claimed is:

1. A swimming pool bottom hydraulic pushed automatic cleaner, comprising:

an underwater cleaner and a control power supply, which are connected together by a cable, wherein:

the underwater cleaner comprises a housing cover part, a housing body part, a filter, a double extension shaft motor assembly, a hydraulic driven jaw-type clutch impeller combination, a water inlet/outlet flow passage, a wheel and bracket, an isolated hood and a cable, wherein the hydraulic driven jaw-type clutch impeller combination includes:

an impeller with sharp teeth on an end surface of a hub and a shaft sleeve with sharp teeth on an end surface, the two end surfaces with sharp teeth being a pair of meshing surfaces, wherein:

the shaft sleeve is fixed in the root of an outrigger shaft of a double extension shaft motor assembly;

the impeller is sleeved on the end portion of the outrigger shaft;

the impeller is axially slidable and rotatable;

the impeller and the shaft sleeve constitute a pair of jaw-type clutches; and along with the changing of the rotating direction of a motor, the impeller and the shaft sleeve are reliably engaged and disengaged under the action of hydraulic power to change the working state of the impeller;

the housing cover part, the housing body part, the double extension shaft motor assembly, the hydraulic driven jaw-type clutch impeller combination, the water inlet/outlet flow passage and the cable constitute an axial-flow pump with double water injection nozzle;

both ends of the motor of the double extension shaft motor assembly are provided with outrigger shafts;

the motor is watertight;

the hydraulic driven jaw-type clutch impeller combination is installed on the outrigger shaft of the double extension shaft motor assembly;

the water inlet/outlet flow passage comprises a flow passage, a flow guide cover and a swinging cap;

the water inlet/outlet flow passage is a water inlet/outlet channel, with a water inlet in the front end and a water outlet in the tail end;

the housing cover part comprises a housing cover and a lock catch;

the housing body part comprises a housing body, a one-way water inlet valve, a suction pipe, a one-way drain valve and a deflection member;

the housing cover and the housing body are hermetically connected with each other through the lock catch;

the one-way water inlet valve is arranged at the bottom of the housing body;

the suction pipe is extracted from the front and rear ends at the bottom of the housing body, and extended under the leading and trailing edges of the underwater cleaner;

the deflection member is an adjustment feeler lever arranged in the leading edge of the housing cover;

the filter comprises a filter bracket and a filter bag;

the filter is installed at the bottom of the housing body;

the one-way water inlet valve and the upper end of the suction pipe are arranged within the filter;

the wheel and the bracket is fixedly installed on the side of the housing body;

the isolated hood is placed between the filter and the double extension shaft motor assembly and installed on the housing cover; and the control power supply comprises a power supply, a control circuit and a chassis.

2. The swimming pool bottom hydraulic pushed automatic cleaner according to claim 1, wherein:

the number of the double extension shaft motor assembly is two, the two assemblies are arranged parallelly, and provided with four water outlet injection nozzles in total; and the automatic cleaner also comprises a remote controller, which performs wireless remote control on the cleaner and comprises a communication circuit, a battery and a housing.

3. The swimming pool bottom hydraulic pushed automatic cleaner according to claim 2, wherein the power supply is a 12V AC power supply.

4. The swimming pool bottom hydraulic pushed automatic cleaner according to claim 3, wherein a motor shell is made of metal material.

5. The swimming pool bottom hydraulic pushed automatic cleaner according to claim 2, wherein a motor shell is made of metal material.

6. The swimming pool bottom hydraulic pushed automatic cleaner according to claim 2, wherein the cable is a buoyancy cable, which comprises a cable and floaters.

7. The swimming pool bottom hydraulic pushed automatic cleaner according to claim 2, wherein:

the suction pipe is arranged in the front end and the rear end at the bottom of the underwater cleaner;

the ends of the suction pipe are under the leading and trailing edges of the housing; and the orifice of the suction pipe is funnel-shaped.

8. The swimming pool bottom hydraulic pushed automatic cleaner according to claim 3, wherein the cable is a buoyancy cable, which comprises a cable and floaters.

9. The swimming pool bottom hydraulic pushed automatic cleaner according to claim 3, wherein:

the suction pipe is arranged in the front end and the rear end at the bottom of the underwater cleaner;

the ends of the suction pipe are under the leading and trailing edges of the housing; and the orifice of the suction pipe is funnel-shaped.

10. The swimming pool bottom hydraulic pushed automatic cleaner according to claim 1, wherein the power supply is a 12V AC power supply.

11. The swimming pool bottom hydraulic pushed automatic cleaner according to claim 10, wherein a motor shell is made of metal material.

12. The swimming pool bottom hydraulic pushed automatic cleaner according to claim 10, wherein the cable is a buoyancy cable, which comprises a cable and floaters.

13. The swimming pool bottom hydraulic pushed automatic cleaner according to claim 10, wherein:

the suction pipe is arranged in the front end and the rear end at the bottom of the underwater cleaner;

the ends of the suction pipe are under the leading and trailing edges of the housing; and the orifice of the suction pipe is funnel-shaped.

14. The swimming pool bottom hydraulic pushed automatic cleaner according to claim 1, wherein a motor shell is made of metal material.

15. The swimming pool bottom hydraulic pushed automatic cleaner according to claim 14, wherein:

the suction pipe is arranged in the front end and the rear end at the bottom of the underwater cleaner;

the ends of the suction pipe are under the leading and trailing edges of the housing; and the orifice of the suction pipe is funnel-shaped.

16. The swimming pool bottom hydraulic pushed automatic cleaner according to claim 14, wherein:

the one-way drain valve is arranged on the lower portion of the housing body side; and the cover plate of the valve is an elastic silica gel plate.

17. The swimming pool bottom hydraulic pushed automatic cleaner according to claim 1, wherein the cable is a buoyancy cable, which comprises a cable and floaters.

18. The swimming pool bottom hydraulic pushed automatic cleaner according to claim 1, wherein:

the suction pipe is arranged in the front end and the rear end at the bottom of the underwater cleaner;

the ends of the suction pipe are under the leading and trailing edges of the housing; and the orifice of the suction pipe is funnel-shaped.

19. The swimming pool bottom hydraulic pushed automatic cleaner according to claim 1, wherein:

the one-way drain valve is arranged on the lower portion of the housing body side; and the cover plate of the valve is an elastic silica gel plate.

* * * * *

UNITED STATES PATENT AND TRADEMARK OFFICE

CERTIFICATE OF CORRECTION

PATENT NO. : 8,555,445 B2
APPLICATION NO. : 13/499551
DATED : October 15, 2013
INVENTOR(S) : Fu et al.

It is certified that error appears in the above-identified patent and that said Letters Patent is hereby corrected as shown below:

On the Title Page, Item (76), under "Inventors", in Column 1, Line 6, delete "Xianozhou Lv," and insert -- Xiaozhou Lv, --, therefor.

Signed and Sealed this
First Day of April, 2014

Michelle K. Lee

Michelle K. Lee
*Deputy Director of the United States Patent and Trademark Office*